United States Patent [19]

Jonsson

[11] 4,199,955

[45] Apr. 29, 1980

[54] HEAT EXTRACTION OR RECLAMATION APPARATUS FOR REFRIGERATING AND AIR CONDITIONING SYSTEMS

[75] Inventor: Kjartan A. Jonsson, Ballston Lake, N.Y.

[73] Assignee: Sun-Econ, Inc., Ballston Lake, N.Y.

[21] Appl. No.: 906,508

[22] Filed: May 16, 1978

Related U.S. Application Data

[62] Division of Ser. No. 736,004, Oct. 27, 1976, Pat. No. 4,089,667.

[51] Int. Cl.[2] ..... F25B 7/00; F25B 27/02

[52] U.S. Cl. ..... 62/79; 62/238; 165/2

[58] Field of Search ..... 62/79, 238 E, 238 R, 62/506; 165/2

[56] References Cited

U.S. PATENT DOCUMENTS

| | | | |
|---|---|---|---|
| 2,516,094 | 7/1950 | Ruff | 62/238 |
| 2,690,649 | 10/1954 | Borgerd | 62/238 |
| 3,188,829 | 6/1965 | Siewert et al. | 62/238 |
| 3,301,002 | 1/1967 | McGrath | 62/238 |
| 3,500,897 | 3/1970 | Von Cube | 62/238 |
| 3,563,304 | 2/1971 | McGrath | 165/2 |
| 3,916,638 | 11/1975 | Schmidt | 62/238 |
| 3,922,876 | 12/1975 | Wetherington, Jr. et al. | 62/238 |
| 3,926,008 | 12/1975 | Webber | 62/506 |
| 3,989,183 | 11/1976 | Gustafsson | 62/238 E |

OTHER PUBLICATIONS

Florida Power Corporation, "Heat Recovery Water Heating Systems", May, 1972.

Chambers, M. B., "Heat Recovery Service Water Heating for Motels, Restaurants, Cafeterias," Bldg Systems Design, Jun./Jul., 1975.

Bierenbaum, N. S., "Waste Heat Recovery in Food Processing", Waste Heat Management Handbook, N.B.S. Publication No. 121, 1977.

Wetherington, T. I., Jr., "Heat Recovery Domestic Hot Water Heating", Building Systems Design, Jun., Jul., 1975.

*Primary Examiner*—Lloyd L. Ring

*Attorney, Agent, or Firm*—Pollock, Vande Sande & Priddy

[57] ABSTRACT

A heat extraction or reclamation system particularly adapted to recover otherwise rejected heat from the refrigerant gas flowing through air conditioning and refrigerating systems includes a counter-flow heat exchanger for transferring heat to a medium such as water, the heat exchanger being installed in the tubing upstream of the conventional condenser. The heat extraction system has a pump for circulating water or other medium to be heated, located on one side of the heat exchanger. Hot refrigerant gas, the so-called superheated gas flowing from the compressor of the air conditioning or refrigerating system, is circulated through the other side of the heat exchanger. The pump flow rate and the heat transfer area between the refrigerant gas and the water or other medium are chosen to ensure that the refrigerant gas outlet quality remains within limits which ensure flow continuity in operation. Refrigerant gas leaving the system will contain some liquid in the form of droplets or a small stream. The water temperature is maintained within limits by stopping the pump when the inlet water temperature reaches a predetermined maximum value. Refrigerant velocity through the heat exchanger is reduced compared to velocity at compressor discharge in some embodiments to lengthen residence time in the heat exchanger sufficiently to increase heat transfer from the refrigerant gas and yet provide an excess quantity of heat in the refrigerant gas compared to the heat removal capacity of the flowing water.

3 Claims, 19 Drawing Figures

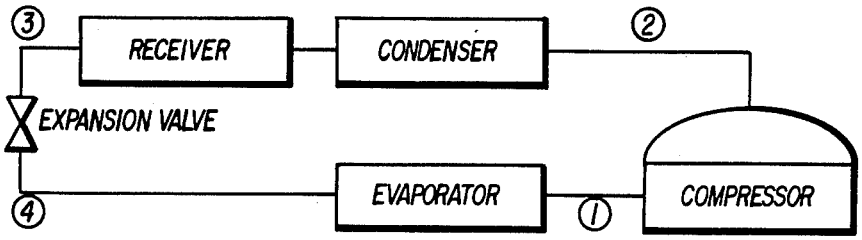
FIG. 1 PRIOR ART
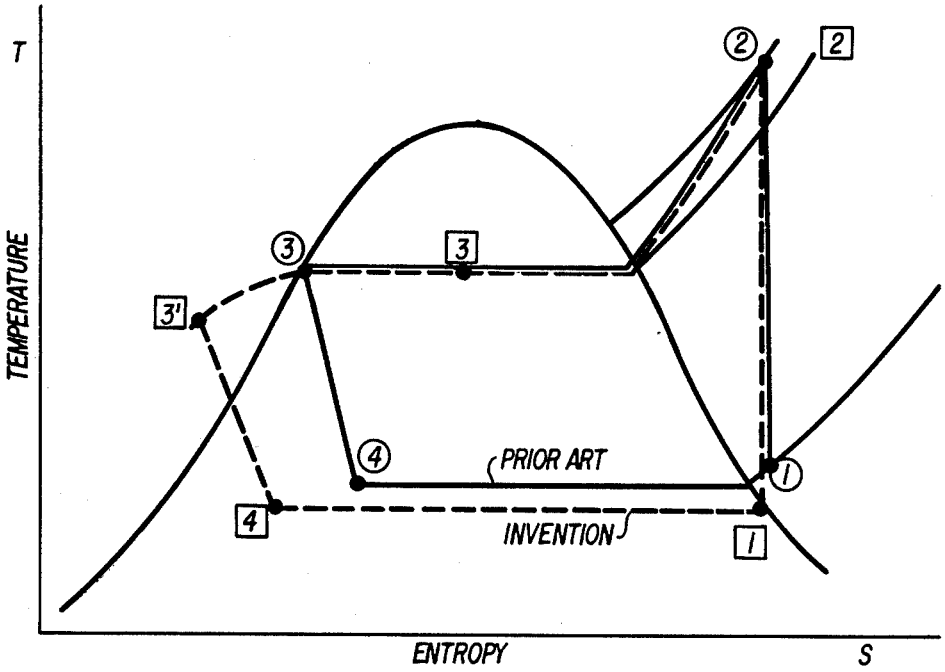
FIG. 2
FIG. 3
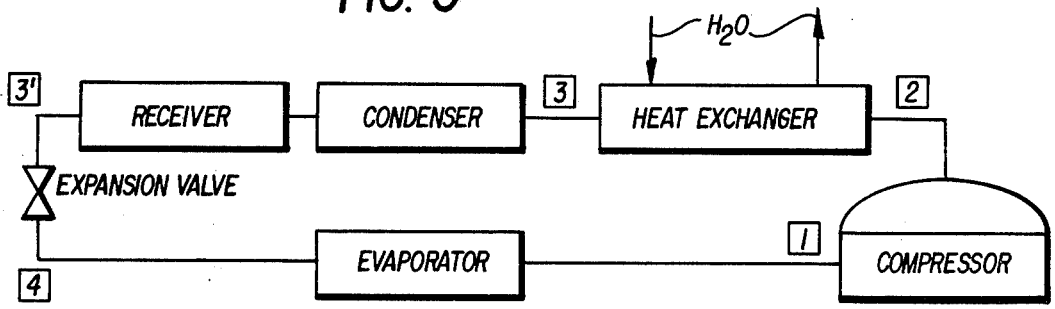

FIG. 11
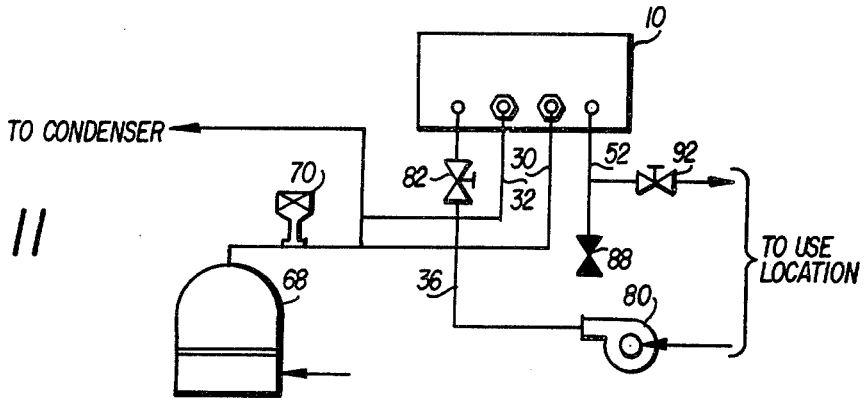
FIG. 12
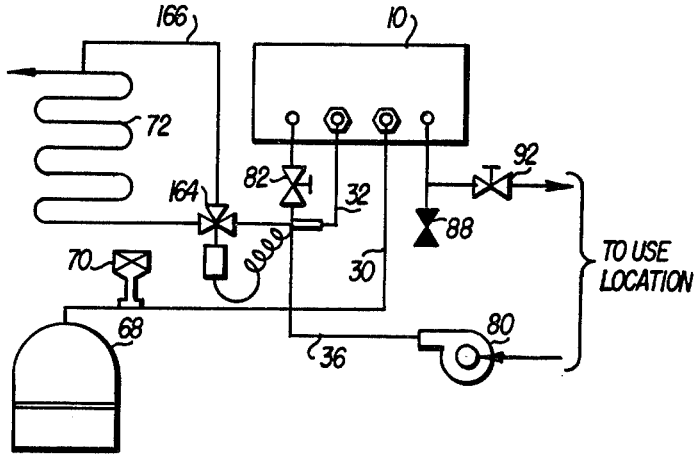
FIG. 16
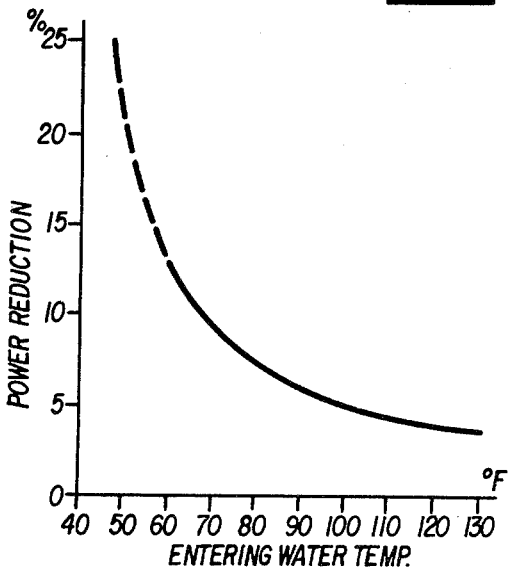
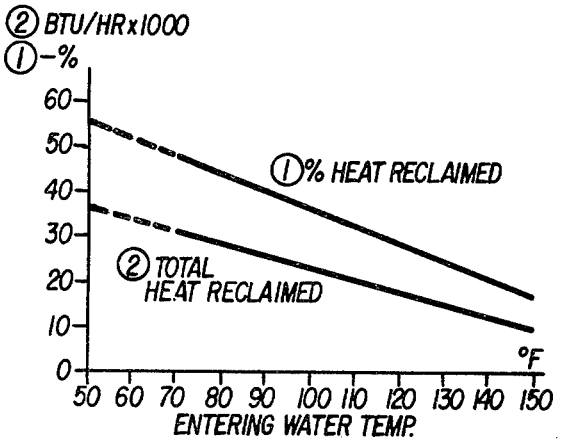
FIG. 17

FIG. 14 TEST DATA ON 5 THROUGH 10 TON CAPACITY SUPPLEMENTAL HEAT EXCHANGER DISCHARGE PRESSURE TEST CONDUCTED AT 95°F DRY BULB

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| RDG. NO. | ELAPSED TIME MIN. | REF. IN PSIG. | REF. OUT PSIG. | REF. ΔP PSIG. | WATER IN °F | WATER OUT °F | WATER Δt °F | WATER FLOW RATE GPM | $Q_w$ 500x(8)x(9) BTU/hr | O.D. AMB AIR °F | AIR OFF COND °F | AIR Δt °F | $Q_a$ 2916 x (12) BTU/hr | $Q_a+Q_w$ BTU/hr | % HEAT RE-CLAIMED |
| START | 0 | 215 | 205 | 10 | 64 | 119 | 55 | 1.05 | 28875 | 72 | 76 | 4 | 11664 | 40539 | 71.2 |
| 1 | 10 | 260 | 252 | 8 | 67 | 133 | 66 | 1.06 | 34980 | 95 | 105 | 10 | 29160 | 64140 | 54.5 |
| 2 | 20 | 287 | 277 | 10 | 82 | 139 | 57 | 1.08 | 30780 | 95 | 108 | 13 | 37908 | 68688 | 44.8 |
| 3 | 30 | 305 | 297 | 8 | 124 | 155 | 31 | 1.09 | 16895 | 95 | 109 | 14 | 40824 | 57719 | 29.3 |
| 4 | 40 | 318 | 307 | 11 | 132 | 161 | 29 | 1.10 | 15950 | 95 | 111 | 16 | 46656 | 62606 | 25.5 |
| 5 | 50 | 325 | 317 | 8 | 148 | 171 | 23 | 1.11 | 12765 | 95 | 111 | 16 | 46656 | 59421 | 21.5 |
| 6 | 60 | 323 | 316 | 7 | 155 | 177 | 22 | 1.11 | 12210 | 95 | 111 | 16 | 46656 | 58866 | 20.7 |
| 7 | 70 | 325 | 319 | 6 | 164 | 184 | 20 | 1.11 | 11100 | 95 | 111 | 16 | 46656 | 57756 | 19.2 |
| 8 | 80 | 327 | 319 | 8 | 170 | 188 | 18 | 1.11 | 9990 | 95 | 111 | 16 | 46656 | 56646 | 17.6 |
| 9 | 90 | 332 | 323 | 9 | 176 | 192 | 16 | 1.11 | 8880 | 95 | 111 | 16 | 46656 | 55536 | 16.0 |
| 10 | 100 | 333 | 327 | 6 | 180 | 196 | 16 | 1.11 | 8880 | 95 | 112 | 17 | 49572 | 58452 | 15.2 |

HEAT EXTRACTION OR RECLAMATION APPARATUS FOR REFRIGERATING AND AIR CONDITIONING SYSTEMS

This application is a division of application Ser. No. 736,004 filed Oct. 27, 1976, now U.S. Pat. No. 4,089,667.

BACKGROUND OF THE INVENTION

Recent years have seen a strong emphasis on efficient use of the world's limited resources, particularly in the energy or electric power field. The limited supply of fossil fuels has especially aggravated the need for more efficient energy usage. At the same time, factors such as modern building design, high seasonal temperatures (depending on location), poorer outdoor air quality and increased demand for frozen and perishable foods have combined to produce an ever-increasing demand for large, expensive-to-operate and frequently inefficient air conditioning and refrigerating equipment.

While the demand for such equipment has had the beneficial effect of strengthening the various manufacturers thereof, the intensive use of the equipment has placed heavy burdens on the power production capacities of public utilities in many localities. Such air conditioning and refrigerating systems consume prodigious amounts of power in doing their work and, by their design, reject very large amounts of energy, usually to the atmosphere, to cool and condense their hot refrigerant gas. In such systems, the flowing refrigerant liquid is expanded, thereby lowering its temperature. Heat is then absorbed from the area to be cooled, thereby lowering the area's temperature and converting the refrigerant back to a gas. After this, the refrigerant gas is compressed to restore it to high pressure. To remove the heat absorbed from the area to be cooled, most conventional prior art systems pass the refrigerant gas through a condenser where the refrigerant gas is cooled under essentially constant pressure usually until it reaches a state close to a saturated liquid or perhaps to a state with a slight degree of subcooling. The heat removed is normally dissipated into the surrounding air at the location of the condenser. This represents a tremendous waste in energy over a period of time. Could this energy be effectively harnessed, substantial economies would result.

One approach to this problem is shown in U.S. Pat. No. 3,922,876. In this device, the refrigerant gas is passed through one side of a heat exchanger located upstream of the condenser to reject heat to water flowing intermittently through the other side of the heat exchanger. To control condensation in the heat exchanger, the patented device includes a temperature sensitive valve which stops water flow when the water inlet temperature drops to the temperature at which an unacceptable portion of the refrigerant gas would condense. Thus, when connected to a hot water heating system, the patented device will be inoperative for water inlet temperatures below about the 100° F. to 140° F. range where most commercially available refrigerants will condense completely. Until the water inlet temperature is high enough, the conventional hot water heater must reheat the water. This results in rather long recovery times and very little saving due to heat reclamation, particularly during high demand periods. Unfortunately, the bulk of the heat contained in the refrigerant gas will be lost while waiting for the inlet temperature of the water to rise, leading to reduced efficiency of reclaiming heat from the refrigerant.

Various other prior art systems have included some sort of supplemental heat exchanger for transmitting heat from the refrigerant to a hot water system. U.S. Pat. Nos. 2,516,093, 2,751,761, 3,188,829, 3,301,002, 3,308,877, 3,366,166, 3,563,304, 3,916,638, and 3,926,008 show typical prior art refrigerating approaches including means for heating water by absorbing heat from the refrigerant using a supplemental heat exchanger at a location upstream of the conventional condenser. In these cases, however, the teachings of the patents to those skilled in the art are rather clear that the supplemental heat exchanger, or pre-cooler for the refrigerant gas, as it is sometimes called, is to be placed in a large volume of water relative to the volume of refrigerant flowing through the heat exchanger at a given point in time. Because of this, at least until the water has been heated substantially beyond the usual temperature range for municipal water of 35° to 55° F., the refrigerant would be expected to condense completely to a saturated liquid in the pre-cooler heat exchanger, leaving for the conventional condenser the task of subcooling the liquid refrigerant and for the compressor the added work of circulating liquid through a greater part of the system.

In systems where the compressor flow rates; piping lengths; relative height of compressor and condenser; presence of low points; flow velocity reducing elements such as elbows and bends in refrigerant tubing; system insulation; number of valves and related factors can be adjusted at the time of system installation, the presence of such large amounts of liquid refrigerant upstream of the conventional condenser may be acceptable. However, where it is desired to modify an existing installation to include a supplemental heat exchanger for heating a medium such as water, the system parameters such as those just listed are not easily, economically changed in most instances.

Since it is desirable to modify an existing system as little as possible when providing a supplemental heat exchanger for hot water, the amount of liquid refrigerant in the discharge from the supplemental exchanger is of considerable importance. An excess of liquid can lead to collection of puddles of mixtures of liquid refrigerant and the lubricating oil usually carried with the refrigerant gas, at low points in the refrigeration system tubing leading to the conventional condenser, or even in the supplemental heat exchanger itself. If these puddles form slugs which block the refrigeration system tubing, the tubing upstream becomes over-pressurized as the compressor keeps on pumping in more gas; and the tubing downstream becomes starved as the compressor keeps on pumping away its refrigerant. The refrigeration capacity of the system deteriorates until the puddle or slug of liquid begins to move rapidly through the system under the influence of the higher upstream pressure. This movement continues with "rifle shot" speed until another low point is reached, following which the process repeats itself. Should a slug reach the compressor or another vital component, serious damage may result. Such slugs have been known to rupture the tubing. Or, the slugs or other large amount of liquid entering the conventional condenser may first flood its inlet plenum and then the condenser itself, giving rise to poor performance. Thus, following such prior art teachings concerning refrigerating and air conditioning systems, supplemental heat exchangers for heating a medium such as water would not lead to satisfactory results when modifying an existing system.

OBJECTS OF THE INVENTION

An object of the invention is to provide a means for efficiently and safely removing and using otherwise-wasted heat from air conditioning and refrigerating systems.

Another object of the invention is to provide such a means which is readily adaptable for use as part of a new air conditioning and refrigerating system or as an addition to an old system, of varying capacities, without adversely affecting their performance and reliability in other respects.

Another object of the invention is to provide such a device which not only will permit efficient use of excess heat reclaimed from the refrigerant gas, but also will cause the air conditioning and refrigerating system itself to operate more efficiently.

Still another object of the invention is to provide such a device which is rugged and simple in construction, uncomplicated for installation and low in initial cost and frequency of maintenance.

A further object of the invention is to provide such a device for installation upstream of the conventional condenser for removing heat from the refrigerant gas without producing excessive condensation of the refrigerant.

Yet another object of the invention is to provide such a device which will permit continuous water flow from the lowest temperature experienced in municipal water supplies to an upper limit predetermined by design and most often below the boiling point of water.

A still further object of the invention is to provide such a device which will stop water flow when the inlet water temperature reaches the predetermined upper limit.

Another object of the invention is to provide such a device including a coaxial, counterflow heat exchanger.

Another object is to provide a heat exchanger having an improved heat exchanger surface formed by shot blasting.

These objects of the invention are given only by way of example. Thus, other desirable objectives and advantages inherently achieved by the invention may be apparent to those skilled in the art. Nonetheless, the scope of the invention is to be limited only by the appended claims.

SUMMARY OF THE INVENTION

The above objects and other advantages are achieved by the disclosed invention which provides a supplemental hot water heat exchanger for installation in air-conditioning and refrigerating systems at a location between the conventional compressor and conventional condenser. To prevent the formation of flow blockages, condenser flooding, and similar detrimental effects, the heat removal capacity of the heat exchanger is limited so that the quality of the refrigerant gas leaving the heat exchanger will be within specified limits. By ensuring that a certain amount of refrigerant gas vapor will be flowing in the system even when rather large amounts of refrigerant liquid condensate are present, the invention ensures that an existing system my be modified by adding a heat exchanger for heating water without reducing the refrigerating or air-conditioning capacity of the system. As will be discussed subsequently, the addition of a heat exchanger for heating water according to the present invention actually improves the overall efficiency of the host air-conditioning or refrigerating system.

In one embodiment of the invention, the heat exchanger for heating water comprises a coaxial, counterflow heat exchanger of a type similar to those used as water-cooled condensers in the prior art, which has been modified in accordance with the teachings of the present invention. It has been found that by shot blasting the exterior surface of the water tube in the heat exchanger, the heat transfer characteristics of the device are improved considerably; however, exchangers without shot blasting also perform well. Also, by providing rifling grooves on the interior surface of the water tube, turbulence is increased thereby improving heat transfer at that surface. The overall performance of the heat exchanger is improved considerably by enlarging the flow area of the shell containing the refrigerant gas relative to the flow area of the tubing conveying refrigerant gas to the heat exchanger from the system compressor. Enlargement of the refrigerant gas flow area within the shell ensures that a large mass of refrigerant gas will always be in the heat exchanger next to the water tube. This large mass of refrigerant contains and is capable of rejecting more heat, without producing an unacceptable amount of refrigerant condensate, than the water flowing through the central tube is capable of removing. Thus, an additional factor of safety is achieved. Moreover, the increase in flow area within the shell produces a reduction in refrigerant velocity thereby increasing the residence time of each volume of refrigerant gas as it moves through the heat exchanger for hot water and improving heat transfer from the refrigerant gas to the water.

BRIEF DESCRIPTION OF THE DRAWINGS

FIG. 1 is a block diagram of a conventional prior art refrigerating or air-conditioning system.

FIG. 2 is a temperature-entropy diagram qualitatively comparing a prior art system to the invention.

FIG. 3 is a block diagram of a refrigerating or air-conditioning system embodying the present invention.

FIG. 11 shows an alternate form of the invention in which the heat exchanger is connected in parallel with the refrigerant line.

FIG. 12 shows an alternate form of the invention in which the discharge of refrigerant from the heat exchanger is by-passed around the condenser under some conditions, using a temperature and pressure controlled three-way valve.

FIG. 14 is a table showing typical performance data for one embodiment of the invention.

FIG. 16 shows a plot indicating the percent reduction in compressor power as a function of water inlet temperature.

FIG. 17 shows a plot indicating reclamation of heat as a function of water inlet temperature.

DETAILED DESCRIPTION OF THE PREFERRED EMBODIMENTS

Figure 13:
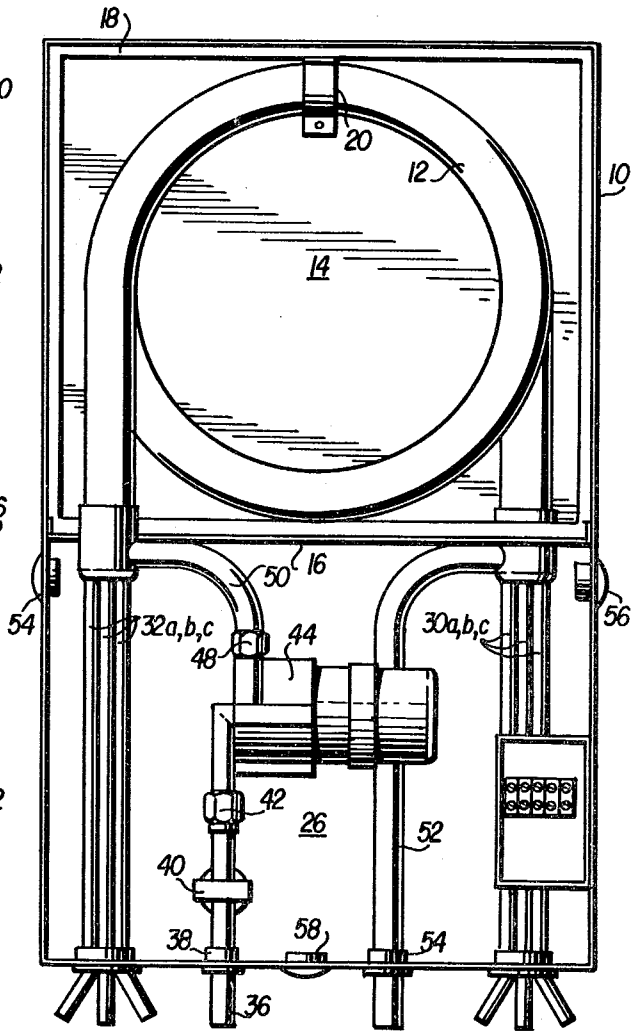
FIG. 13 shows an alternate, multi-pass form of the invention adapted for receiving refrigerant from a plurality of compressors.

There follows a detailed description of various embodiments of the invention, reference being made to the drawings in which like reference numerals identify the elements of structure of the several Figures.

FIG. 1 shows a block diagram schematic of a conventional prior art refrigerating or air-conditioning system. Low pressure saturated, or slightly superheated, refrigerant is drawn into a compressor at point ① and discharged as a high pressure, high temperature superheated vapor at point ②. From point ②, the refrigerant gas flows through a conventional condenser in which it is condensed to a saturated or sometimes slightly subcooled liquid which then typically passes to a receiver, although receivers are not included in all systems. At point ③ on the downstream side of the receiver, the liquid refrigerant passes through an expansion valve; and from point ④, it passes through an evaporator in which heat is absorbed from the location or body to be cooled.

FIG. 2 illustrates qualitatively, graphically through the medium of a conventional temperature-entropy diagram the performance of the prior art system. Thus at point 1, the refrigerant is a low pressure, slightly superheated gas. At point 2, the refrigerant is a high pressure, high temperature superheated gas. As the refrigerant gas passes through the condenser, the superheat and the heat of condensation are removed bringing the refrigerant first through the saturated vapor stage and finally to a saturated liquid condition at point 3. From there, the expansion device provides a nonreversible expansion to point 4 after which the refrigerant is vaporized at essentially constant temperature and pressure in the evaporator and flows as a saturated, low temperature gas to the inlet of the compressor.

FIG. 3 shows a schematic, block diagram of a refrigerating or air-conditioning system similar to that shown in FIG. 1; but in this case, the system includes a supplemental heat exchanger according to the present invention located between the compressor outlet and the inlet of the conventional condenser. The various points in the system are identified by reference numerals corresponding to those in FIG. 1 but enclosed in boxes. Referring again to FIG. 2, the improved performance of a system embodying the present invention can be seen in the dashed lines. Starting at point ②, the refrigerant is partially condensed in the supplemental heat exchanger according to the present invention until it reaches point ③. Then, the conventional condenser takes over, completes the condensation of the refrigerant to a saturated liquid and, in many cases, further subcools the liquid to point ③. The expansion valve then permits the refrigerant liquid to expand to point ④ at a pressure and temperature significantly lower than that obtained in the conventional system. Thus, when the refrigerant has passed through the evaporator, it reaches inlet ① of the compressor as a saturated vapor rather than a superheated vapor as in the case of the FIG. 1 system. Because the vapor is saturated or only slightly superheated in systems embodying the present invention, its volume per pound mass is considerably lower and its temperature is lower. The lower temperature and volume means that the compressor must make fewer strokes to move a given mass of gas. The lower temperature also means that the compressor will run at a lower temperature, assuming that a conventional hermetic compressor is used in which the refrigerant cools the compressor. The net result of these effects is that the compressor operates more efficiently as will be discussed subsequently with respect to FIG. 16.

Figure 5:
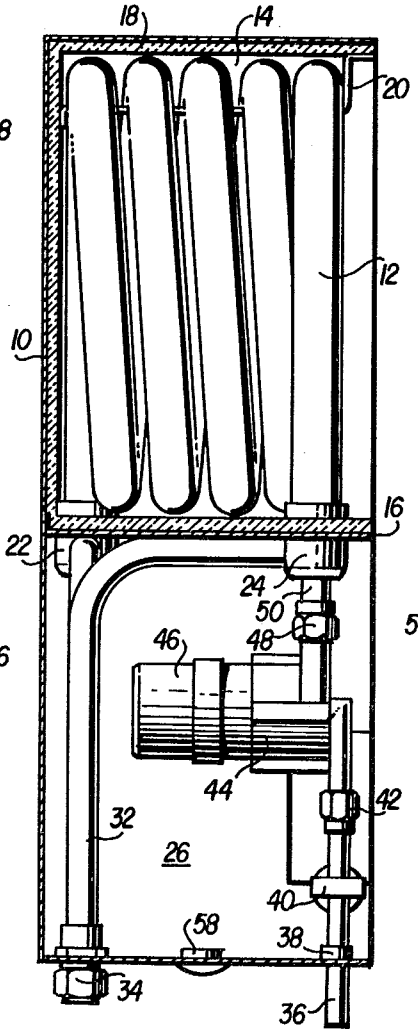
FIG. 5 is a view taken on line 5—5 of FIG. 4.
Figure 4:
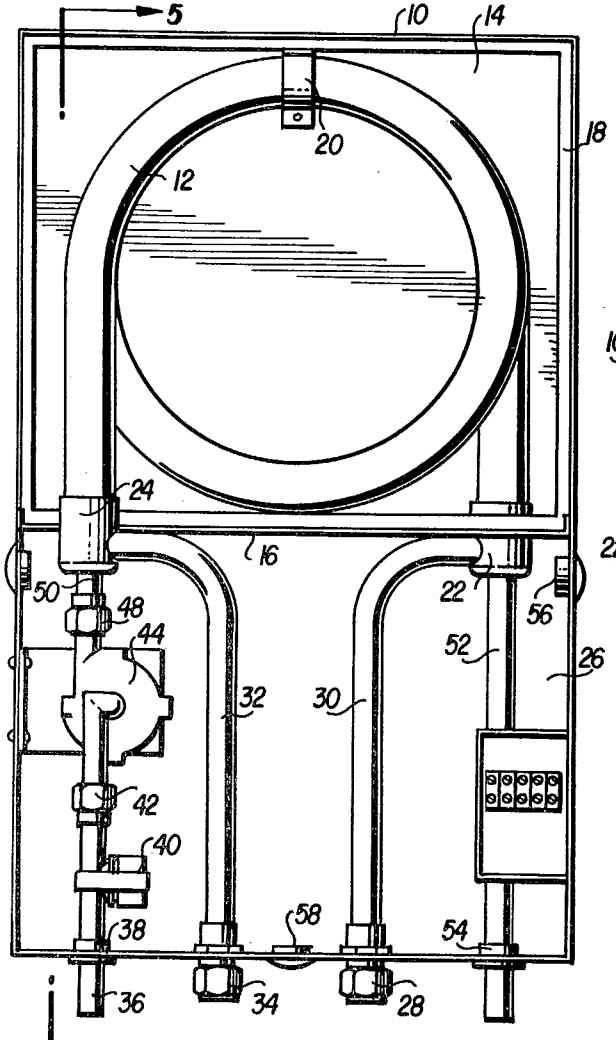
FIG. 4 is an elevation view of a heat extraction system according to the invention, the front cover panel having been removed to allow observation of the components of the invention.

FIG. 4 and 5 show front and side elevation views of a hot water heat exchanger system according to the invention. A sheet metal housing 10 encloses a coaxial, counterflow heat exchanger 12 located within a compartment 14 defined by a central wall 16. Compartment 14 is insulated on all interior surfaces by blankets 18 of insulating material such as on-half inch matte face fiberglass pad material of three pound density, available from the Johns-Manville Company. Heat exchanger 12 is preferably a tube-within-a-tube cylindrical coil of the general type such as that manufactured by the Packless Company of Mt. Wolf, Pa.; however, certain improvements are made in accordance with the teachings of this invention, as will be discussed herein. Those skilled in the art will recognize, of course, that other heat exchanger types may be used within the scope of the invention. A coil strap 20 secures heat exchanger 12 within compartment 14. Inlet/outlet bosses 22 and 24 are attached to the ends of heat exchanger 12 and extend below central wall 16 into a pump compartment 26. Hot refrigerant gas flows into housing 10 through a union adapter 28 connected, as will be described subsequently, to the tubing leading from the discharge side of an air-conditioning or refrigerating compressor. Of course, other types of connectors may be used. From union 28, refrigerant gas flows through tubing 30, through boss 22 and into the shell portion of heat exchanger 12. At the other end of heat exchanger 12, the cooler refrigerant flows out through boss 24, through tubing 32 and through a union adaptor 34 connected to the tubing leading to the conventional condenser of an air conditioning or refrigerating system.

Water for cooling the refrigerant gas flows into housing 10 through tubing 36 connected to a hot water storage system or other hot water device, as will be discussed herein. A plastic bushing 38 retains tubing 36 where it passes through the wall of housing 10. A temperature sensing switch 40 is attached to conduit 36. Switch 40 is set to open or break the power circuit at a temperature of about 180° F. or other suitable water temperature as required by design for a particular application. The temperature is chosen to prevent excessively high temperatures is the hot water usage system, such as in a hot water storage tank, and to provide a margin of safety. Where the heat exchange medium is water, a set point of 180° F. is preferred. Tubing 36 is connected by a fitting 44 to the suction port of a pump 42 which preferably is of a centrifugal type such as Model 809 made by the March Manufacturing Company of Glenview, Ill., having a magnetic coupling so that the heat exchange medium is not contaminated by the pump. Pump 44 is powered by an electric motor 46, as shown in FIG. 5, which operates only when the compressor is in operation and switch 40 is closed. The discharge of pump 44, which is typically in the range of 1.2 to 3.0 g.p.m. depending on anticipated system pressure drops, is connected by a fitting 48 and short tubing 50 to boss 24. Water thus flows through boss 24, the central tube portion of heat exchanger 12, boss 22 and into tubing 52 which passes out of housing 10 through a bushing 54 and is connected to a hot water storage use system or other usage point.

In use, housing 10 is closed by a metal cover, not shown in FIGS. 4 and 5. The portion of the cover closing compartment 14 is insulated as previously described to minimize heat losses from compartment 14. Due to the insulation blankets 18, the temperature in pump compartment 26 is maintained well below that in compartment 14. This is necessary to keep temperature sensing swich 40 from opening due to the effect of a high ambient temperature in the pump compartment 26, which could result in premature stopping of the water flow and attendant wastage of heat contained in the refrigerant gas. Also, pump motor 46 is shielded from operation in an undesirably hot environment. To further ensure the maintanence of proper temperature in pump compartment 26, vent plugs 55, 56, and 58 are provided to permit convective air flow through the comparment and thus help maintain the temperature at a desirable level.

Figure 6A:
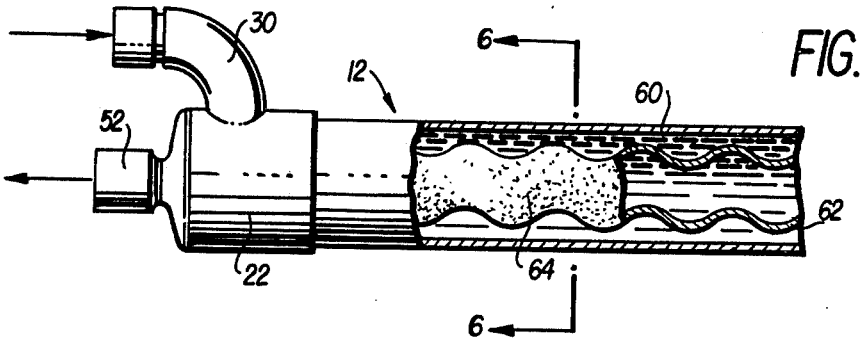
FIG. 6A is a schematic representation of the preferred type of heat exchanger coil for use in the invention, including arrows to illustrate the movement of gas and liquids through the device.

FIG. 6a shows schematically a fragmentary view of the hot refrigerant gas inlet/hot water outlet of a heat exchanger 12 of the type preferred for the invention. The basic geometry shown is similar to that made by the Packless Company. Boss 22 is sealed to an outer, steel cylindrical shell 60 through which refrigerant gas flows; and to an inner, soft copper tube 62 through which water or other heat exchange medium flows, preferably in the counter current direction. The wall of tube 62 is spirally convoluted as indicated also in FIG. 6B to induce a sort of oppositely rotating movement of the hot refrigerant and the cooler water, thereby improving heat transfer area and providing desirable turbulent flow in tube 62. Heat exchangers having other interior geometries may also be used without departure from the scope of this invention.

The relative sizes of the components of heat exchanger 12 are determined in accordance with the teachings of the present invention. Since the entire heat exchanger system enclosed within housing 10 is paticularly well adapted for addition to existing air conditioning and refrigerating systems which already have a refrigerant gas condenser and receiver designed to handle the heat rejection and liquid refrigerant storage needs of the system, it is vital for optimum efficiency of operation that the addition of the heat exchanger to remove otherwise wasted heat will not reduce the air-conditioning or refrigerating capacity of the system. The conventional condenser in prior art air conditioning and refrigerating systems is designed for relatively high velocity flow; thus, formation of condensate puddles or slugs which might block gaseous refrigerant flow is minimized since condensate droplets are quickly carried over to the system receiver located just downstream of the condenser, where a receiver is in use. Compressor flow capacities in such systems are matched reasonably well to the expected flow resistance of the condenser, expansion device and evaporator so that the addition of substantial flow resistances in the system is highly undesirable. For example, the presence of slugs of condensed refrigerant in the tubing leading to the condenser would place an additional load on the compressor since the heavier liquid would be harder to move through the system. The slugs would also jeopardize the integrity and reliability of the system. If such slugs were to collect in low places upstream of the condenser, complete flow blockage could result for a period of time while the compressor builds up the pressure upstream of the slug. Downstream of such a slug, the condenser and evaporator would be pumped down with an attendant loss in cooling capacity. Finally, the situation can arise where the slug is rapidly shot through the system which can result in serious damage.

Since the refrigerant gas temperature is at its highest level between the compressor and the condenser in an existing system, it is desirable to remove excess heat at this location. For a refrigerant flowing at a mass flow rate of $M_1$, the quantity of heat $Q_1$ available for reclamation may be defined by the following relationship:

$$Q_1 = M_1[h_g{}^i - h_g{}^e + (1-X)h_{fg}{}^e],$$

where $h_g{}^i$ is the enthalpy of the refrigerant gas entering the enclosed flow volume defined between shell 60 and tube 62; $h_g{}^e$ is the enthalpy of the refrigerant gas leaving this flow volume; X is the quality, or ratio of vapor mass to liquid mass plus vapor mass, of the refrigerant leaving this flow volume; and $h_f{}^{eg}$ is the difference in enthalpy between saturated liquid and saturated vapor leaving this flow volume. Applicant has determined that when X is in the range 0.25 to 1.0 at the outlet of the refrigerant flow volume of the heat exchanger, the gas remaining in the system will have sufficient velocity to move the liquid refrigerant and oil droplets through the system without the apparent formation of the undesirable slugs previously mentioned. During start up transients, when the water inlet temperature is very low, X may become as low as 0.04 without serious side effects; however, continuous operation in this condition is not considered desirable. Another way of viewing this aspect of the invention is to consider the flow area which remains for gas when liquid droplets or small puddles begin to form in the refrigerant tubing. Applicant has found that as long as the gas flow area is approximately $\frac{1}{4}$ to $\frac{1}{3}$ of the total area, adequate gas flow will be obtained to prevent or minimize greatly any slug formation.

The amount of heat which can be reclaimed from the refrigerant and yet not have the quality of the refrigerant drop below 0.25 at the heat exchanger outlet is determined by the heat absorption capacity of the water or other heat exchange medium flowing in tube 62. The heat $Q_2$ which can be withdrawn by the water or other heat exchange medium may be represented by the following relationship:

$$Q_2 = M_2(h_f^e - h_f^i),$$

where $h_f^e$ is the enthalpy of the water at the outlet of the heat exchanger; and $h_f^i$ is the enthalpy of the water at the inlet of the heat exchanger. Obviously the amount of heat $Q_2$ transferrd to the water is at a maximum when the water inlet temperature is at a minimum. Therefore, if the quality of the refrigerant is not to go below 0.25 (except perhaps briefly during start-up conditions) then $Q_2$ at its maximum must be limited to a value which will ensure that X remains at 0.25 or higher under normally encountered water inlet temperature conditions.

The heat transferred through the wall of tube 62 from the refrigerant to the water may be represented by:

$$Q_3 = UA\overline{\Delta T},$$

where U is the overall heat transfer coefficient for tube 62, A is the surface area of tube 62, and ΔT is an averaged temperature difference through the walls of the tube separating the refrigerant from the water. By selecting the heat exchanger sizes in accordance with the above relationships taught by this invention, the invention may be readily added to existing refrigerating and air conditioning system without producing excessive condensation as discussed previously. Thus, the invention contemplates that the overall heat transfer coefficient U of the tube walls separating the refrigerant from the water (as determined of course by the nature of the material used, its surface characteristics, and the velocity of fluid flow over its opposite surfaces), the heat transfer area A of the tube wall, the averaged temperature difference Δt, and the mass flow rate $M_2$ of the water in the heat exchanger shall all be jointly effective to ensure that, for the given system parameters of the refrigeration system, the quality of the refrigerant leaving the heat exchanger shall not be less than 0.25. Of course, the invention may also be included in new systems.

The invention may be practiced with the total cross sectional flow area in shell 60 equal to the flow area of tubing 30 from the refrigerant compressor; however, it has been found that certain significant advantages are achieved by increasing the size of the flow area in shell 60 relative to tubing 30. This increase in flow area results in a drop in refrigerant velocity while it flows through heat exchanger 12. This increase in volume in shell 60 and its attendant drop in velocity produce some competing effects. For example, the residence time of each volume of refrigerant in heat exchanger 12 is increased, which tends to increase heat transfer to tube 62. Also, the total mass in shell 60 and the total available heat for transfer without total condensation are increased. On the other hand, the heat transfer coefficient through tube 62 decreases as velocity drops, which tends to reduce heat transfer through tube 62. In the invention, the velocity of the refrigerant through the shell 60 is adjusted by selecting a shell flow area sufficiently high to improve heat transfer to the water or other heat transfer medium in tube 62 without reducing the temperature of the refrigerant to levels where excessive liquid will be present. In practice, the flow area of shell 60 may by up to 4 or 5 times larger than the flow area in tubing 30 or larger, depending on the compressor rating. Where heat exchanger 12 is to be used with all compressors in the capacity range of, say, 5 to 10 tons, the shell flow area would have to be sized to operate optimally with a 7.5 ton unit since if it were sized for the 10 ton unit, the 5 ton unit probably would completely condense refrigerant in shell 60 due to excessively low velocity and low amount of refrigerant gas in the heat exchanger shell.

Figure 6B:
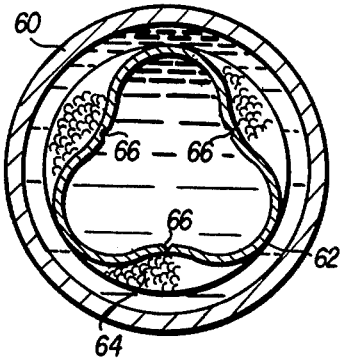
FIG. 6B is a sectional view taken on line 6—6 of FIG. 6A.

Additional advantages are achieved in the invention by shot-blasting or shot-peening the outer surface of tube 62 as indicated at 64 in FIGS. 6A and 6B. This surface treatment technique increases the heat transfer area of the copper tube by as much as 20 percent, thereby greatly improving the heat transfer capacity of heat exchanger 12. Conventional shot blasting techniques may be used for this purpose prior to assembling shell 60 and tube 62. For example, 0.040 to 0.070 inch diameter steel pellets operating under about 175 psi using conventional shot blasting equipment have been found to be effective. Heat transfer is also improved by rifling grooves 66 into the interior surface of tube 62 at the small diameter locations indicated, opposite to the valleys formed between the spiral bulges on the outer surface of tube 62.

Based on actual operating experience with heat exchangers embodying the present invention, heat may be efficiently removed from systems having compressors of from 1 to 100 tons capacity and operating with conventional refrigerants such as R-22. The flow rate $M_1$ in such instances is usually in the range of 2.8 to 280 pounds per minute through a shell area in the range of 0.340 to 3.87 square inches. Water flows rates of 1 to 30 gallons per minute can be accomodated with water tube flow areas of 0.145 to 0.775 square inches, assuming a heat transfer area of 0.55 to 27.5 square feet.

Figure 7:
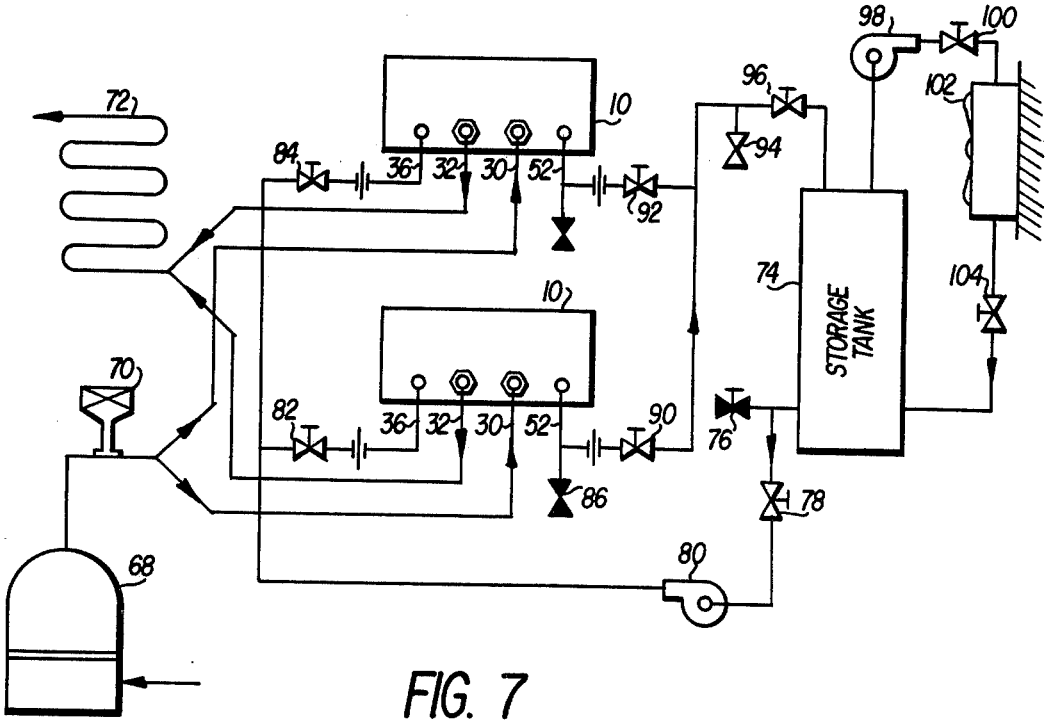
FIG. 7 is a schematic diagram of a system for heating hot water embodying two heat extraction systems according to the invention, including provision for local heaters using the hot water produced.

FIG. 7 shows a schematic diagram of an application of the supplemental heat exchanger according to the present invention. An existing air-conditioning or refrigerating compressor 68 discharges high pressure, high temperature refrigerant past a heat pressure controller 70, after which the flow of refrigerant gas is divided to flow through tubing 30 into a pair of parallel heat exchangers according to the present invention, located within housings 10. After the heat has been reclaimed from the refrigerant gas, the gas leaves housings 10 through tubing 32, recombines and flows to an existing air conditioning or refrigerating condenser coil 72 after which it flows to the evaporator coil (not shown).

On the water or other heat exchange medium side of the system, a storage tank 74 is provided which discharges water past a hose bib 76, through a gate valve 78 to an auxiliary pump 80 which pumps the water or, if desired, other heat exchange medium through parallel gate valves 82 and 84 into water inlet tubing 36. After flowing through the heat exchanger located in housings 10, the water leaves through tubing 52 and passes air bleeds 86 and 88, gate valves 90 and 92, air bleed 94 and gate valve 96 before returning to storage tank 74. Of course, the invention may be used in systems which do not have a storage tank. An auxiliary system comprising a pump 98, gate valve 100, use location 102 and gate valve 104 serves to circulate heated water from storage tank 74 to a location for its intended use. Use location 102 may be a unit heater located in a room to be heated, a coil located in a supply air duct, a baseboard heat exchanger, a water source heat pump, a radiant heat panel, a radiator, and the like.

Figure 8:
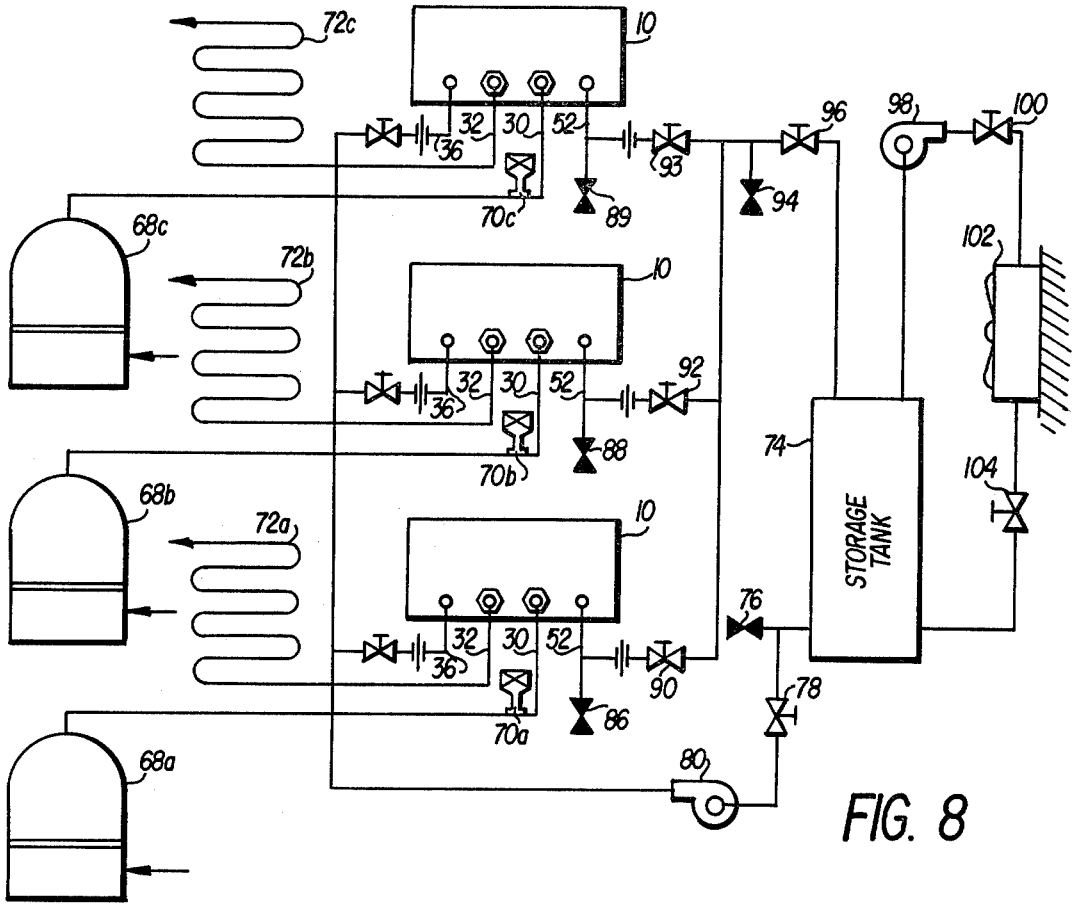
FIG. 8 is a schematic diagram of a system for heating hot water using heat extracted from a plurality of compressors to heat water passing through a plurality of heat extraction systems according to the invention.

FIG. 8 shows another application of the invention in which several existing air conditioning or refrigerating compressors **68*a*, 68*b*, and 68*c* are connected to parallel heat exchangers according to the present invention, located in housings 10. Individual head pressure controllers 70***a*, 70*b*, and 70*c* are provided for each compressor and the refrigerant gas pumped by each compressor passes to separate existing air conditioning or refrigerating condenser coils 72*a*, 72*b*, and 72*c*. On the water side, an additional gate valve 85, air bleed 89, and gate valve 93 and associated tubing are provided to direct water flow to the additional heat exchanger. After recombination of the hot water flows from the various heat exchangers, the flow passes to storage tank 74 in the manner previously described.

Figure 9:
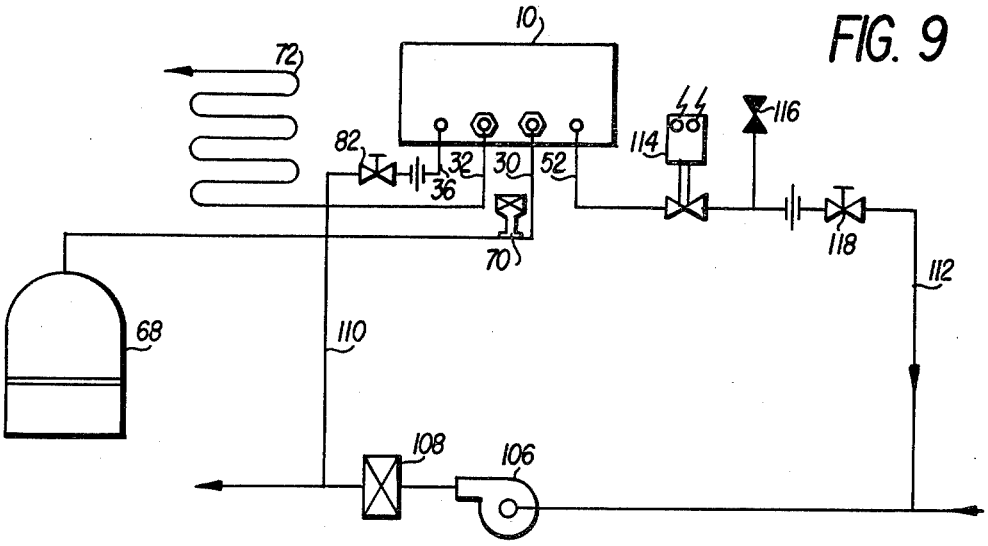
FIG. 9 shows a schematic diagram for a swimming pool heating system embodying the invention.

FIG. 9 shows a schematic diagram of an application of the heat exchanger according to the invention for warming the water flowing through the filter system of a swimming pool. Water is drawn from the swimming pool by an existing pool pump 106 and passed through an existing pool filter 108 after which a portion of the water flow is drawn off to a parallel mounted heat exchanger located within housing 10, via inlet tubing 110 and outlet tubing 112. After passing through the heat exchanger, the water flows through a solenoid actuated valve 114, past bleed tube 116, and through gate valve 118 to return to the swimming pool. Because the heat exchanger in this embodiment is connected in parallel with the pool pump 106. There will always be flow in line 110 and out 112 unless the heat exchanger is manually isolated by gate valves 82 and 118. Since manual isolation of the heat exchanger could be rather inconvenient for the user, solenoid valve 114 is provided which can be actuated remotely to stop flow through the hot water heat exchanger. Alternatively, solenoid valve 114 could be actuated by a temperature sensor located in the swimming pool (not shown) to stop flow through the heat exchanger when the swimming pool temperature reaches a preselected limit as measured at switch 40. It is also possible to connect the heat exchanger in series with the existing pool pump on the downstream side of the existing pool filter (not shown). In this situation, a by-pass including a throttling valve should be provided around the how water heat exchanger to permit the pool pump to continue operation when the heat exchanger has been isolated and also to permit adjustment of the flow rate through the heat exchanger.

Figure 10:
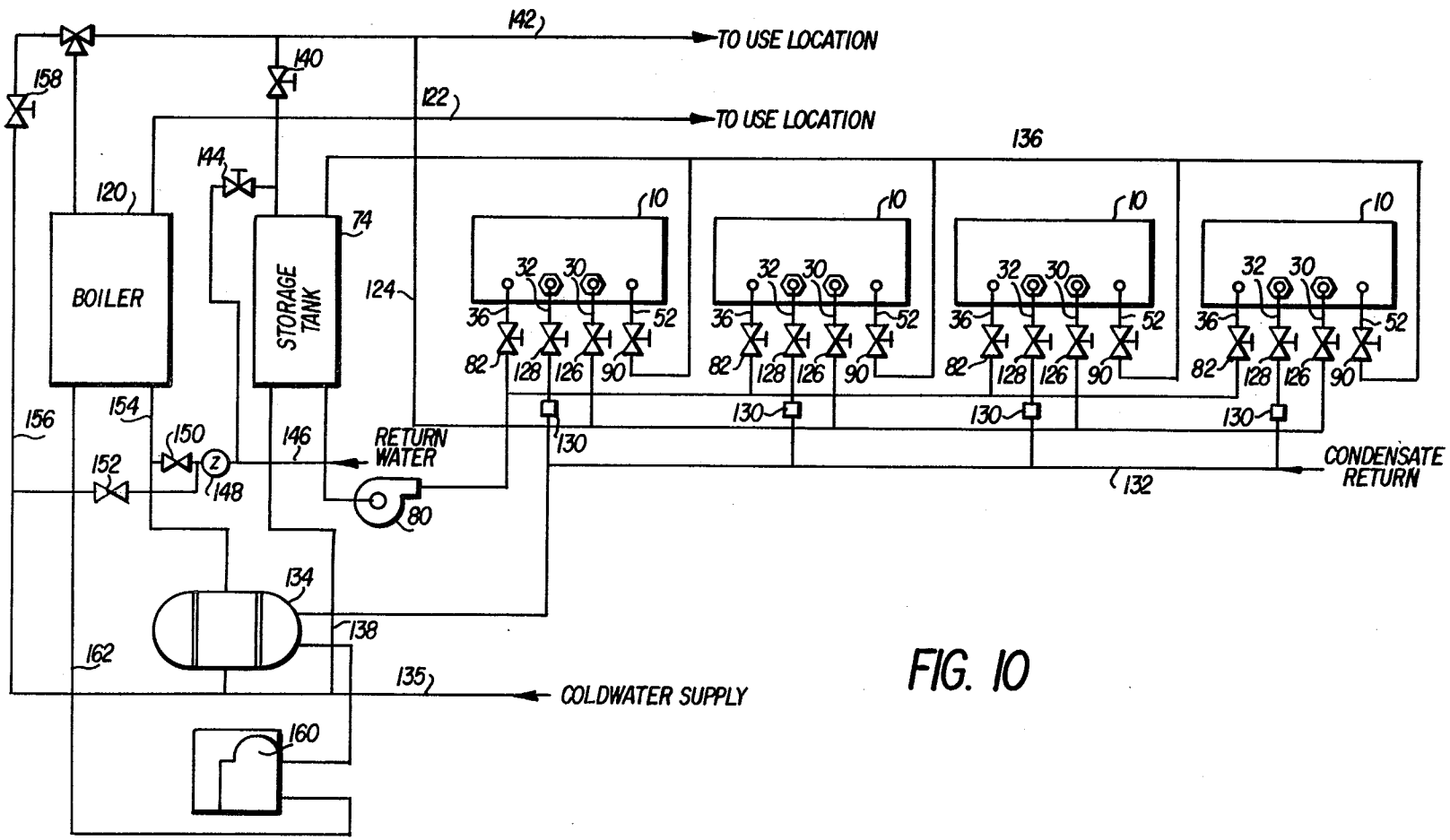
FIG. 10 shows a schematic diagram of a system for heating hot water using steam or a mixture of steam and condensate from a boiler in the heat exchanger of the invention.

FIG. 10 shows a schematic diagram of a hot water heating system embodying the present invention in which the hot water is heated by extracting heat from steam or steam plus condensate mixture, delivered by a conventional boiler 120. Steam flows from boiler 120 on main line 122 to various application points such as unit heaters, dryers, and the like. A portion of the steam flowing in main line 122 is bled off through tubing 124 to flow to the inlet conduits 30 of a plurality of heat exchangers located in housings 10, via gate valves 126. Condensate leaves the heat exchangers via tubing 32 and gate valves 128 and returns via traps 130 to a preheat tank 134 where it warms cold water entering the system on line 135.

Water drawn from storage tank 74 by pump 80 is circulated through the heat exchangers and heated prior to discharging to collection header 136 and returning to tank 74. Also flowing into tank 74 through line 138 is cold water from a supply source (not shown). Hot water from tank 74 is removed via gate valve 140 to hot water supply line 142 through which it flows to its use application, such as washers.

A portion of the water withdrawn from storage tank 74 is passed via gate valve 144 to combine with return water circulating in line 146. A circulating pump 148 passes this mixture to branch lines leading to check valves 150 and 152. The water passing check valve 150 is combined with warm water coming from preheat tank 134 and then passed via line 154 to boiler 120. Flow passing check valve 152 enters line 156 and there combines with cold water flowing on line 135 and upstream of gate valve 158, combines with hot water in line 142. Finally, the condensate reaching preheat tank 134 via line 132 is returned to the boiler by condensate pump 160 and line 162. Those skilled in the art will realize that various other arrangements and combinations of the heat exchanger according to the invention with a conventional steam and hot water generating plant are within the scope of the invention.

The various embodiments of the invention previously discussed have shown the heat exchanger according to the invention located to receive all of the refrigerant gas flow leaving the existing compressor 68. FIG. 11 shows a modification of these previously described embodiments in which the heat exchanger is located in a parallel position relative to the refrigerant gas tubing leading to the existing condenser. Where only a limited amount of heat is to be added to the circulating water, or when the compressor has more capacity than the heat exchanger can handle effectively, the lower refrigerant flow obtained in this arrangement may be sufficient.

In some applications of the heat exchanger according to the invention, factors such as the hot water demand, fluctuations in the water inlet temperature, compressor loading and the like may induce conditions for a transient period of time under which complete condensation of the refrigerant will be experienced. To cope with this sort of operating condition, which is not considered to be desirable, the embodiment of the invention shown in FIG. 12 provides a three-way, temperature and pressure sensitive valve 164 in the refrigerant discharge tubing 32 leading from the heat exchanger. If the temperature and pressure of the refrigerant leaving the heat exchanger drops to a level at which the refrigerant will condense completely, valve 164 is actuated to direct flow into by-pass tubing 166 which is connected to the system on the downstream side of the existing condenser 72. Although the heat exchanger according to the invention is not intended to operate as a water-cooled condenser in this manner, the provision of valve 164 and bypass 166 may be desirable in some instances. A similar temperature sensitive valve and by-pass could also be provided in the embodiment shown in FIG. 11 if desired.

FIG. 13 shows a modification of the heat exchanger shown in FIG. 4. The embodiment of the invention shown in FIG. 13 is a lower capacity version of the invention than that shown in FIGS. 4 and 5; otherwise, the basic elements of the invention are identical in function. Basically, the embodiment of FIG. 13 differs from that of FIG. 4 in the provision of a plurality of refrigerant inlet tubes 30*a, b, c,* and outlet tubes 32*a, b, c,* as indicated. By this means, it is possible to connect a hot water heater exchanger having multiple inlets to a plurality of compressors, thereby reducing the number of heat exchangers required and the overall complexity of the system.

Numerous embodiments of the disclosed invention have been tested extensively to determine their specific performance characteristics. FIG. 14 shows in tabular form various test data which were generated on a test of a refrigerating system including a supplemental heat exchanger according to the invention. The supplemental heat exchanger used during the test was sized to be usable in refrigerating and air conditioning systems of 5 through 10 ton capacity. This test was conducted at an equivalent outside or ambient air temperature of 95° F., dry bulb. Additional tests in ambient temperatures 85° F. to b 100° F. have also been conducted with similar results. The temperature of 95° F. dry bulb corresponds to the rating temperature used to evaluate refrigerating and air conditioning equipment in the United States under the present ARI standards. Among other things, the data shown in FIG. 14 indicate that the heat exchanger according to the invention is capable of heating water having an inlet temperature in the neighborhood of 64° to an outlet temperature of 119° in a very short elapsed time, i.e., in a single pass. Also, the heat exchanger reclaimed a maximum of 71.2% of the heat which would have otherwise been rejected to the atmosphere during first pass operation. During these tests, the water was continuously recirculated through a storage tank so that as its temperature rose during the course of the test, the percent of heat reclaimed dropped as shown in FIG. 14 as the inlet water temperature approached its limit of 180°.

Figure 15B:
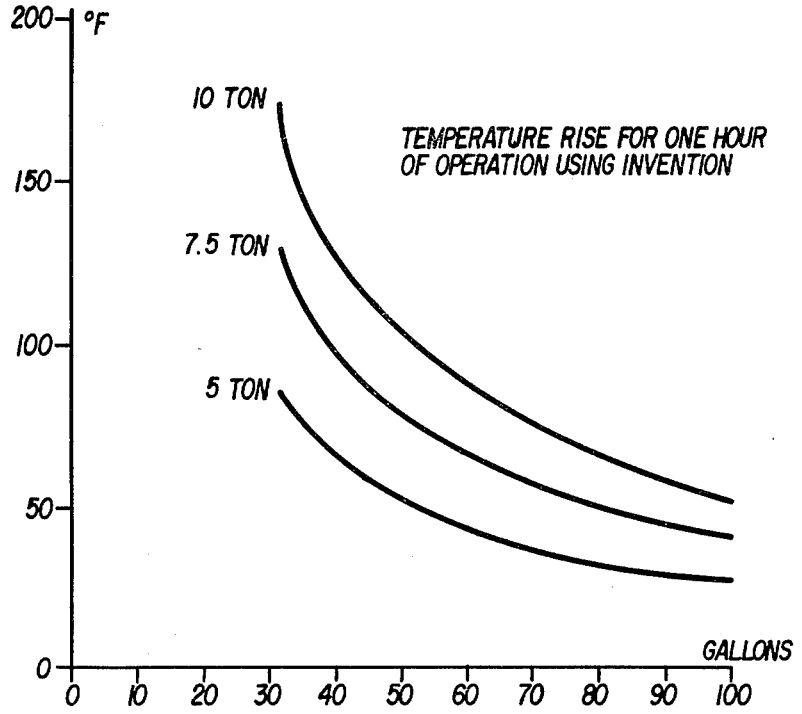
FIG. 15B shows a plot indicating the increase in temperature of a given quantity of water in one hour using the invention.
Figure 15A:
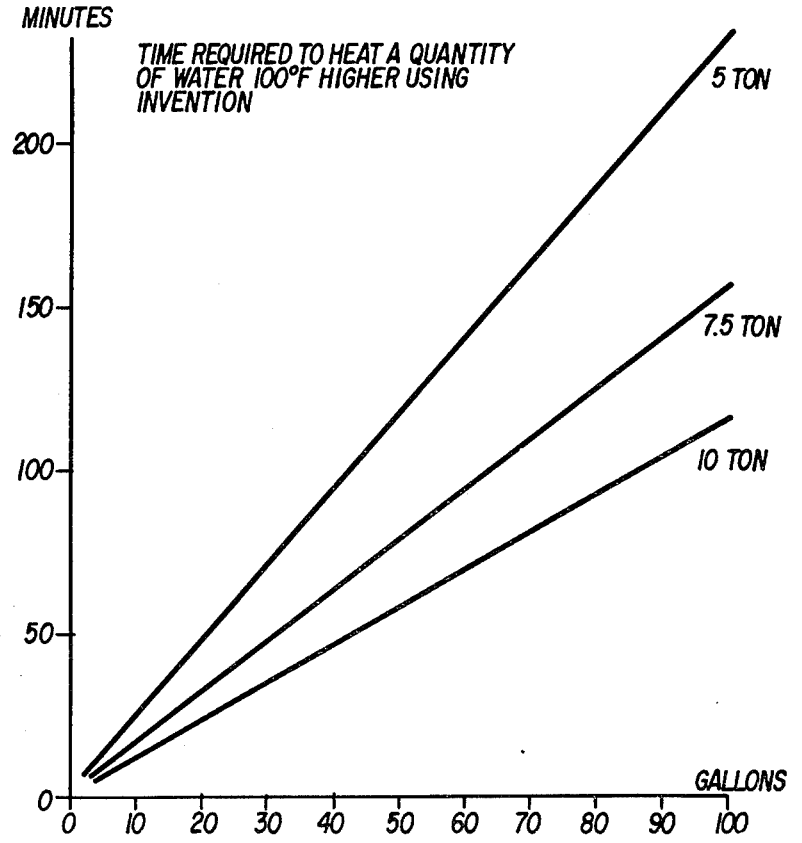
FIG. 15A shows a plot indicating the time required to raise a given quantity of water 100° F. using the invention.

FIG. 15A shows the time required for an actual production model of the invention to raise a given quantity of water 100° F. in temperature. Thus, using a 7.5 ton compressor system, 40 gallons of water were heated 100° F. in about 1 hour without any auxiliary heating. Where a conventional hot water heater is used, it frequently is unnecessary to leave the heater coils or gas in service where the invention is in use, however, recovery times will be even faster if both the conventional hot water heat source and the invention are used. FIG. 15B shows a similar plot indicating the change in temperature of a given quantity of water in one hour, for various compressor sizes.

The percentage of power reduction at the compressor is shown as a function of the inlet water temperature in FIG. 16. When the system is operating with water inlet temperature in the lower ranges, the refrigerant passing through the hot water heat exchanger according to the invention is cooled more substantially than at the higher inlet temperature ranges. Accordingly, the inlet temperature at the compressor is lower which reduces the compressor power requirements and wear and tear, as discussed previously. However, even at the higher inlet water temperatures, the compressor power requirements are reduced.

FIG. 17 shows a graphical representation of the dependence of the percentage of heat reclaimed upon the inlet water temperature to the heat exchanger. Although the data presented in FIG. 17 were generated in small capacity air conditioning and refrigerating systems, the trend toward a reduction in the percent of heat reclaimed as the inlet water temperature rises is clearly demonstrated. Of course, for a given size of heat exchanger, the efficiency of the system drops as the capacity of the air conditioning or refrigerating system is increased.

Having described my invention in sufficient detail to enable those skilled in the art to make and use it, I claim:

1. In a method for reclaiming the heat otherwise transferred to the atmosphere by the refrigerant in a conventional refrigeration or air conditioning system having acompressor, a condenser, and an evaporator, in which the refrigerant is caused to flow through a heat exchanger as it leaves the compressor but before it enters the condenser so as to transfer the heat in the refrigerant to a heat transfer medium also flowing through the heat exchanger, and in which the refrigerant as it leaves the compressor has a quantity of heat $Q_1$ available for reclamation defined by $Q_1=M_1[h_g^i-h_g^e+(1-X)\ h_{fg}^e]$, where $M_1$ is the mass flow rate of the refrigerant in the system, $h_g^i$ is the enthalpy of the refrigerant gas leaving the compressor, $h_g^e$ the enthalpy of the refrigerant gas leaving the heat exchanger, X the quality of the refrigerant as it leaves the heat exchanger, and $h_{fg}^e$ the difference in enthalpy between saturated liquid refrigerant and saturated vapor refrigerant leaving the heat exchanger, the refrigerant and the fluid transfer medium respectively flowing through separate flow paths in the heat exchnager in opposite directions, the dividing wall separating said first and second flow paths havng a surface area A and a heat transfer coefficient U, and the heat transfer medium being circulated through the second flow path with a mass flow rate $M_2$ and a predetermined velocity, the improvement comprising:

selecting the said surface area A and the said heat transfer coefficient U for said dividing wall in the heat exchanger and controlling the mass flow rate $M_2$ and velocity of the heat transfer medium through the second flow path such that the heat transferred to said heat transfer medium, when the inlet temperature of the heat transfer medium is at its expected minimum value, is proportionally so related to the quantity of heat $Q_1$ available for reclamation that the quality X oof the refrigerant exiting from the first flow path of the heat exchanger will not go below about 0.25.

2. A method for reclaiming the heat otherwise transferred to the atmosphere by the refrigerant in a conventional refrigeration or air conditioning system having a compressor, a condenser, and an evaporator, comprising the steps of causing said refrigerant to flow through a heat exchanger as it leaves the compressor but before it enters the condenser so as to transfer at least a portion of the heat in the refrigerant to a heat transfer medium also flowing through the heat exchanger, the refrigerant and the heat transfer medium respectively flowing through separate flow paths in the heat exchanger in opposite directions; and transferring heat from the refrigerant to the heat transfer medium in the heat exchanger at a rate sufficiently great such that all the superheat and also a portion of the latent heat will be transferred to the heat transfer medium when the temperature of the heat transfer medium is below the condensation temperature of the refrigerant, the rate of heat transfer being also limited to an upper value such that for the minimum expected temperature of the heat transfer medium entering its flow path in the heat exchanger, the quality of the refrigerant leaving its flow path in the heat exchanger will not go below about 0.25.

3. The method of claim 2 characterized further in that maintenance of the quality of the refrigerant at about 0.25 or more is attained by selection of the surface area and the heat transfer coefficient of a dividing wall separating the refrigerant from the heat transfer medium in the heat exchanger and also by selection of the mass flow rate and velocity of the heat transfer medium.

* * * * *